United States Patent [19]

Hauser

[11] 4,442,612

[45] Apr. 17, 1984

[54] ORTHOPEDIC PADS

[75] Inventor: Theodor E. Hauser, Bethel Park, Pa.

[73] Assignee: Hapad, Inc., Bethel Park, Pa.

[21] Appl. No.: 400,724

[22] Filed: Jul. 22, 1982

[51] Int. Cl.[3] ..... A43B 13/40; A43B 19/00

[52] U.S. Cl. ..... 36/43; 36/71.5; 36/71; 36/91; 36/44

[58] Field of Search ..... 36/43, 71, 91, 44, 71.5; 128/586, 596

[56] References Cited

U.S. PATENT DOCUMENTS

| | | | |
|---|---|---|---|
| 3,265,071 | 8/1966 | Kirchner et al. | 128/586 |
| 3,470,880 | 10/1969 | Pagliano | 36/71 |
| 3,548,420 | 12/1970 | Spence | 36/71 |

FOREIGN PATENT DOCUMENTS

| | | | |
|---|---|---|---|
| 296308 | 10/1929 | United Kingdom | 36/71 |
| 840541 | 7/1960 | United Kingdom | 36/71.5 |

*Primary Examiner*—Louis Rimrodt
*Assistant Examiner*—Steven N. Meyers
*Attorney, Agent, or Firm*—Martin J. Carroll

[57] ABSTRACT

A one piece resilient and compressible pad having a generally oblong shape has a flat bottom surface with a rounded rear end, generally parallel longitudinal sides, a substantially straight forward end and rounded corners connecting the forward end to the longitudinal sides. The top surface of the pad is contoured with the forward end of the pad having a flat portion of maximum thickness and its heel end having a flat portion of lesser thickness. A sloping portion is provided between the two flat portions. The dimensions of the pad are selected so that when placed in a shoe with the heel end closely approaching the inside rear of the shoe, the flat portion of maximum thickness will underlie and protect the metatarsal and longitudinal arches.

4 Claims, 8 Drawing Figures

2
4
16
6
20
26
28
30
18
14

16
24
36
34
III
III
22
26
20
IV
IV
30
6
18
V
V
28
32
14

42
44

48
46
44
42

26
34
10
36
4
8
12

10
26
30
12

10
28
12

50
52
54

ORTHOPEDIC PADS

This invention relates to the orthopedic pads and more particularly to such pads for use within a shoe at the instep and heel. The pads are an improvement over the pads shown in Kirchner et al U.S. Pat. No. 3,265,071 dated Aug. 9, 1966. The pads shown in this patent have been in successful use for many years. However, the pad has some drawbacks. In order to absorb the shock to the spine when walking, the pad has been used with a beveled heel pad. The patented pad and the heel pad were held in place by an adhesive. Care was required in placing the pads in the proper position and it was possible to place them improperly. Also, there was no smooth connection between the heel and patented pads.

It is therefore an object of my invention to provide a resilient, compressible, one-piece orthopedic pad which protects the longitudinal and metatarsal arches and also the heel.

Another object is to provide greater comfort with a pad which has a smooth merging surface between the heel and arch portions of the pad.

Still another object is to provide such a pad which is easily placed and retained in the correct position in the shoe.

These and other objects will be more apparent after referring to the following pecifical in which.

Figures 1, 2, 3, 4, 5, 6, 7, 8:
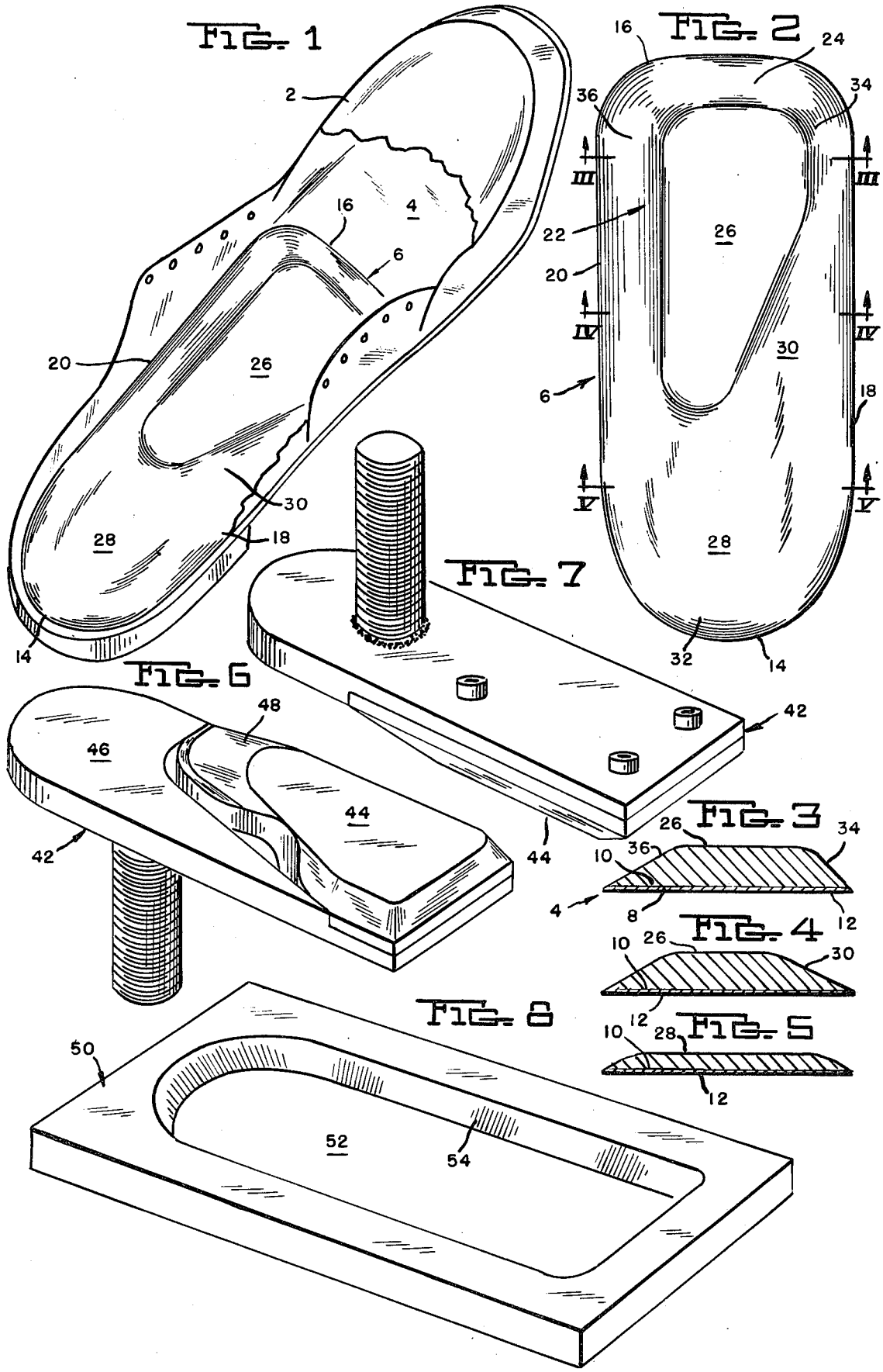
FIG. 1 is a top plan view of the shoe with parts broken away and showing the pad of my invention positioned therein.
FIG. 2 is a plan view of the pad of my invention.
FIG. 3 is a transverse view taken on line III—III of FIG. 2.
FIG. 4 is a transverse view taken on line IV—IV of FIG. 2.
FIG. 5 is a transverse view taken on line V—V of FIG. 2.
FIG. 6 is a perspective view of a male die used in the manufacture of my pad.
FIG. 7 is a perspective view of the male die from its opposite side.
FIG. 8 is a perspective view of the matching female die.

Referring more particularly to the drawings, reference numeral 2 indicates a shoe having an inner sole 4 upon which pad 6 of my invention rests.

While a right hand shoe and pad are shown it will be understood that a pad of opposite hand will be provided for a left hand shoe.

The pad 6 has a flat oblong bottom surface 8 which has a layer of adhesive 10 thereon. A protective strip 12 made of paper, plastic or other suitable material is provided over the adhesive. The rear end 14 of the surface 8 is convex arcuate and of such size and shape that it closely approaches the inside rear of the shoe when inserted therein. This rear end is shown as a semi-circle and will be usually so formed. The forward end 16 of surface 8 is relatively straight, except for its rounded corners, but is preferably slightly convex as shown. Longitudinal sides 18 and 20 of surface 8 are generally parallel to one another, but it is preferred that side 18 be relatively straight and positioned toward the outside of the shoe with longitudinal side 20 being slightly convex. Upper surface 22 is contoured with forward end 24 sloping upwardly and rearwardly to a maximum thickness portion 26 extending rearwardly across the major portion of the front a distance rearwardly sufficient to support the metatarsal arch and rearwardly along side 20 a distance and for a width sufficient to support the longitudinal arch. The length of the surface supporting the metatarsal arch is between approximately 55 and 70% of the width of the pad. For ease of manufacture the portion 26 is shown as having a rectangular forward section and a triangular rearwardly extending section having its hypotenuse extending rearwardly from side 18 toward side 20. The upper surface 22 includes a flat heel portion 28 of lesser thickness than portion 26 which also extends forwardly a distance along the hypotenuse of the triangular section. A sloping portion 30 extends upwardly from portion 12 to portion 26. Rear portion 32 of the pad slopes upwardly and forwardly to upper surface 28. Portion 34 of the pad adjacent side 18 slopes upwardly toward side 20 to the top surface at an angle which is shown as 45 degrees. Portion 36 of the pad adjacent side 20 slopes upwardly toward side 18 to the top surface at an angle which is shown as 30 degrees.

The pad is made of a compressible resilient material such as the wool felt described in U.S. Pat. No. 3,265,071 but other materials may be and have been used. Normally the pads are made from strips of such material having a thickness of ½" or less. As with the patented pads the pads may be made in various thicknesses, but the new pad permits each pad to be used for a greater number of thicknesses. It will be seen that modifications had to be made in the shape of the patented pad in order to arrive at the present one-piece pad. It is apparent that the dimensions of the pad may vary, but those shown in FIGS. 2 to 5 have proved satisfactory. These figures are drawn to a ¾" scale. The thickness of the felt is ½", its maximum width is 2⅞" and its maximum length 6½". The convexity of side 20 is approximately ⅛".

In use the strip 12 usually is pulled off and the pad 6 placed on sole 4 with the flat surface 8 downwardly, the longitudinal side 18 along the outside of the shoe, and the rear end 14 positioned adjacent the inside rear of the shoe. Since the length of the pad 6 is designed so that the metatarsal and longitudinal arches will contact the top portion 26 when the rear end is so positioned no skill is required in properly placing the pad. By placing the circular part of the pad flush with the back of the shoe, the pad will fall into place automatically regardless of the shoe length in almost all cases without further adjustment. There are three pad sizes based on the height of the instep. The pressure sensitive adhesive permits the pad to be taken from the shoe, washed, and returned to the same shoe. This also permits the strip 12 to remain on the pad when positioned in the shoe and to be held in place by a few drops of glue so that the pad can be easily removed and replaced in another shoe.

While the pad may be manufactured in various ways the dies shown in FIGS. 6 to 8 have proved satisfactory. Male die 42 includes a substantially flat portion 44 and a second substantially flat position 46 connected by an intermediate portion 48. For ease of manufacture the parts 44 and 48 are made separate from part 46. A female die 50 having an opening 52 with tapering side walls 54 cooperates with the male die to form pad 6. In manufacture, die 42 in the position shown in FIG. 7 is positioned above die 50 in the position shown in FIG. 8 with the larger portion of opening 52 upwardly. As shown the opening is 3½" by 7¼" at the top and 3" by 6¾" at the bottom. The felt rests on top of die 50 and is pushed downwardly there through by die 42, thus deforming it to the desired shape until the surface 44 is about flush with the bottom of die 50. As the dies come together with the pad material therebetween, the tapers on the sides of the pad are provided by the side walls 54, the portion 26 by portion 44 of the die, the heel portion 28 by die portion 46, and the transition sloping portion 30 by die portion 48. A shear then positioned at approximately the elevation of the bottom of die 50 moves horizontally to shear the pad 6 from the piece of felt. In practice a plurality of pads are made simultaneously in a plurality of die sets.

While one embodiment has been shown and described it will be apparent that other modifications may be made within the scope of the following claims.

I claim:

1. A resilient and compressible one-piece generally oblong pad adapted to be placed in a shoe and extending from the heel to a position under the longitudinal and metatarsal arches of the foot, said pad comprising a substantially flat bottom surface adapted to contact the inner sole of the shoe, the rear end of said surface being convex arcuate and adapted to closely approach the inside rear of the shoe, the forward end of said surface being relatively straight, longitudinal sides of said flat surface being generally parallel to one another, and convex rounded corners of said flat surface connecting said forward end to said longitudinal sides; a contoured upper surface having a maximum thickness portion, a foward end sloping upwardly and rearwardly to said maximum thickness portion, said maximum thickness portion extending rearwardly across the major portion of the front a distance sufficient to support said metatarsal arch and rearwardly along one longitudinal side a distance and for a width sufficient to support said longitudinal arch, a substantially flat portion of less thickness than the maximum thickness portion extending over the heel portion of the shoe, and a sloping portion extending upwardly from the heel portion to said maximum thickness portion, and the portion of the pad adjacent said longitudinal sides sloping upwardly from each longitudinal side toward the other longitudinal side to the top surface, said maximum thickness portion including a rectangular forward section, and a triangular rearwardly extending section having its hypotenuse extending rearwardly from said other side toward said one side.

2. A pad according to claim 1 in which said one longitudinal side is slightly convex and the other longitudinal side is relatively straight.

3. A pad according to claim 1 in which a portion of the said upper surface adjacent the said hypotenuse is in the same plane as its top of the heel portion.

4. A pad according to claim 3 in which the pad material is wool felt.

* * * * *